US008845054B2

(12) United States Patent
Shimizu

(10) Patent No.: US 8,845,054 B2
(45) Date of Patent: Sep. 30, 2014

(54) LIQUID EJECTING APPARATUS, CONTROL DEVICE, AND PROGRAM

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 181 days.

(21) Appl. No.: 13/242,671

(22) Filed: Sep. 23, 2011

(65) Prior Publication Data

US 2012/0081438 A1 Apr. 5, 2012

(30) Foreign Application Priority Data

Sep. 30, 2010 (JP) ..... 2010-221023

(51) Int. Cl.

| | |
|---|---|
| ***B41J 29/38*** | (2006.01) |
| ***B41J 2/21*** | (2006.01) |
| ***B41J 3/54*** | (2006.01) |
| ***B41J 2/165*** | (2006.01) |

(52) U.S. Cl.

CPC ..... *B41J 29/38* (2013.01); *B41J 2/2114* (2013.01); *B41J 3/543* (2013.01); *B41J 2/16526* (2013.01)

USPC ..... 347/14

(58) Field of Classification Search

None

See application file for complete search history.

(56) References Cited

U.S. PATENT DOCUMENTS

| | | | | |
|---|---|---|---|---|
| 5,992,966 | A | 11/1999 | Nitta et al. | |
| 2007/0009275 | A1 * | 1/2007 | Yokoyama | 399/69 |
| 2009/0225119 | A1 * | 9/2009 | Huyghen et al. | 347/14 |

FOREIGN PATENT DOCUMENTS

| | | | | |
|---|---|---|---|---|
| JP | H03-079550 | A | 4/1991 | |
| JP | H10-157153 | A | 6/1998 | |
| JP | 11291476 | A * | 10/1999 | B41J 2/01 |
| JP | H11-291476 | A | 10/1999 | |
| JP | 2000-203009 | A | 7/2000 | |
| JP | 2001-171138 | A | 6/2001 | |
| JP | 2001-171143 | A | 6/2001 | |
| JP | 2001171143 | A * | 6/2001 | B41J 2/175 |
| JP | 2007-001185 | A | 1/2007 | |
| JP | 2007-168278 | A | 7/2007 | |
| JP | 2009-214541 | A | 9/2009 | |

OTHER PUBLICATIONS

Japan Patent Office, Decision of Patent Grant for Japanese Patent Application No. 2010-221023 (counterpart Japanese patent application), dispatched Oct. 2, 2012.

* cited by examiner

*Primary Examiner* — Geoffrey Mruk
*Assistant Examiner* — Bradley Thies
(74) *Attorney, Agent, or Firm* — Merchant & Gould PC

(57) ABSTRACT

A liquid ejecting apparatus includes: a head that contains an ejection surface where a plurality of ejection ports are opened; a sensor that detects a contact between the recording medium and the ejection surface; an ejection duty detecting unit, when the sensor detects the contact, that is configured to detect an ejection duty of the liquids of an image formed in an area of the recording medium, which comes into contact with the ejection surface; and a maintenance unit, when the sensor detects the contact, that is configured to stop an operation based on a record command and is configured to perform maintenance including compulsory ejection which ejects liquids from the ejection ports, wherein the maintenance unit adjusts the amount of the liquids, which are ejected in the compulsory ejection, according to the ejection duty, which is detected by the ejection duty detecting unit.

7 Claims, 11 Drawing Sheets

FIG. 10

| HEAD | INTENSITY OF CONTACT | EJECTION DUTY: d (%) | | | | |
|---|---|---|---|---|---|---|
| | | 0 ≤ d < 75 | 75 ≤ d < 150 | 150 ≤ d < 225 | 225 ≤ d < 300 | 300 ≤ d |
| PRE-COATED HEAD *1 | STRONG | SMALL PURGE | - | - | - | - |
| | WEAK | WEAK FLUSHING | - | - | - | - |
| INKJET HEAD (YELLOW) *2 | STRONG | SMALL PURGE | MEDIUM PURGE | - | - | - |
| | WEAK | WEAK FLUSHING | MEDIUM FLUSHING | - | - | - |
| INKJET HEAD (MAGENTA) *3 | STRONG | SMALL PURGE | MEDIUM PURGE | LARGE PURGE | - | - |
| | WEAK | WEAK FLUSHING | MEDIUM FLUSHING | STRONG FLUSHING | - | - |
| INKJET HEAD (CYAN) *4 | STRONG | SMALL PURGE | MEDIUM PURGE | LARGE PURGE | LARGE PURGE | - |
| | WEAK | WEAK FLUSHING | MEDIUM FLUSHING | STRONG FLUSHING | SMALL PURGE | - |
| INKJET HEAD (BLACK) *5 | STRONG | SMALL PURGE | MEDIUM PURGE | LARGE PURGE | LARGE PURGE | LARGE PURGE |
| | WEAK | WEAK FLUSHING | MEDIUM FLUSHING | STRONG FLUSHING | SMALL PURGE | SMALL PURGE |

*1: d IS ALWAYS 0%, *2: d ≤ 100%, *3: d ≤ 200%, *4: d ≤ 300%, *5: d ≤ 400%

LIQUID EJECTING APPARATUS, CONTROL DEVICE, AND PROGRAM

CROSS REFERENCE TO RELATED APPLICATION

The present application claims priority from Japanese Patent Application No. 2010-221023, which was filed on Sep. 30, 2010, the disclosure of which is herein incorporated by reference in its entirety.

TECHNICAL FIELD

The present invention relates to a liquid ejecting apparatus that ejects a liquid such as an ink, a control device that controls the liquid ejecting apparatus, and a computer readable medium storing a program.

BACKGROUND

There has been known a technique for ejecting two or more kinds of liquids, which have characteristics different from each other, from one or a plurality of heads in an inkjet printer that is an example of a liquid ejecting apparatus. For example, a printer disclosed in Patent Document 1 contains a head that ejects an ink and a head that ejects a pre-treatment liquid having characteristics different from the characteristics of the ink. As the pre-treatment liquid, there is a liquid which functions to improve the density of an ink by making pigments and dyestuffs cohere in the ink, or the like. A pre-treatment liquid and inks, inks of which the colors are different from each other, inks and a post-treatment liquid, and the like are used as the liquids having characteristics different from each other.

[Patent Document 1] JP-A-10-157153

SUMMARY

When the area of a recording medium to which a liquid has adhered comes into contact with the ejection surface of the head that ejects a liquid having characteristics different from the characteristics of the liquid, in the ejection surface, cohesion caused by the reaction between an ink and a treatment liquid (a pre-treatment liquid or a post-treatment liquid), color mixing caused by inks having different colors, and the like may occur. Cohesion causes the ejection ports to be clogged, and causes the ejection performance to deteriorate. Color mixing causes recording quality to deteriorate. Accordingly, when the contact between a recording medium and the ejection surface is detected, in order to prevent cohesion or color mixing, it is considered that an operation based on a record command is stopped and maintenance such as compulsory ejection, which compulsorily ejects a liquid from the ejection ports formed at the ejection surface, is performed.

However, if the amount of the liquid ejected in the compulsory ejection is made constant regardless of the degree of adherence of the liquid to the ejection surface when the above-mentioned maintenance is performed, an amount of liquid larger than necessary is consumed, which causes the liquid to be wasted.

An object of the invention is to provide a liquid ejecting apparatus, a control device, and a program that can reduce the waste of a liquid in a compulsory ejection associated with the contact between a recording medium and an ejection surface.

In order to achieve the above-mentioned object, according to a first aspect of the invention, there is provided a liquid ejecting apparatus that contains one or more heads, sensors, an ejection duty detecting unit, and a maintenance unit. Each of the heads contains an ejection surface where a plurality of ejection ports is opened. The heads eject two or more kinds of liquids, which have characteristics different from each other, to a recording medium from the ejection ports. The sensors detect the contact between the recording medium and the ejection surfaces. The ejection duty detecting unit detects an ejection duty of the liquids of an image formed in an area of the recording medium, which comes into contact with the ejection surface, when the sensors detect the contact. The maintenance unit stops an operation based on a record command and performs maintenance including compulsory ejection, which ejects liquids from the ejection ports, when the sensors detect the contact. The maintenance unit adjusts the amount of the liquids, which are ejected in the compulsory ejection, according to the ejection duty, which is detected by the ejection duty detecting unit.

According to a second aspect of the invention, there is provided a control device used in a liquid ejecting apparatus. The liquid ejecting apparatus contains one or more heads and sensors. Each of the heads contains an ejection surface where a plurality of ejection ports is opened. The heads eject two or more kinds of liquids, which have characteristics different from each other, to a recording medium from the ejection ports. The sensors detect the contact between the recording medium and the ejection surfaces. The control device contains an ejection duty detecting unit and a maintenance unit. The ejection duty detecting unit detects an ejection duty of the liquids of an image formed in an area of the recording medium, which comes into contact with the ejection surface, when the sensors detect the contact. The maintenance unit stops an operation based on a record command and performs maintenance including compulsory ejection, which ejects liquids from the ejection ports, when the sensors detect the contact. The maintenance unit adjusts the amount of the liquids, which are ejected in the compulsory ejection, according to the ejection duty, which is detected by the ejection duty detecting unit.

According to a third aspect of the invention, there is provided a program that makes a liquid ejecting apparatus function as the ejection duty detecting unit and the maintenance unit. The ejection duty detecting unit detects an ejection duty of the liquids of an image formed in an area of the recording medium, which comes into contact with the ejection surface, when the sensors detect the contact. The maintenance unit stops an operation based on a record command and performing maintenance including compulsory ejection, which ejects liquids from the ejection ports, when the sensors detect the contact. The liquid ejecting apparatus contains one or more heads and sensors. Each of the heads contains an ejection surface where a plurality of ejection ports is opened and the heads ejecting two or more kinds of liquids, which have characteristics different from each other, to a recording medium from the ejection ports. The sensors detect the contact between the recording medium and the ejection surfaces. The maintenance unit adjusts the amount of the liquids, which are ejected in the compulsory ejection, according to the ejection duty, which is detected by the ejection duty detecting unit.

According to the invention, the maintenance unit adjusts the amount of a liquid according to an ejection duty in a compulsory ejection associated with the contact between a recording medium and an ejection surface, so that it may be possible to reduce the waste of the liquid.

BRIEF DESCRIPTION OF THE DRAWINGS

Illustrative aspects of the invention will be described in detail with reference to the following figures wherein:

FIG. 10 is a table that is referred to when maintenance is performed; and

DETAILED DESCRIPTION OF EXEMPLARY EMBODIMENTS OF THE PRESENT INVENTION

Preferred embodiments of the invention will be described below with reference to drawings.

Figure 1:
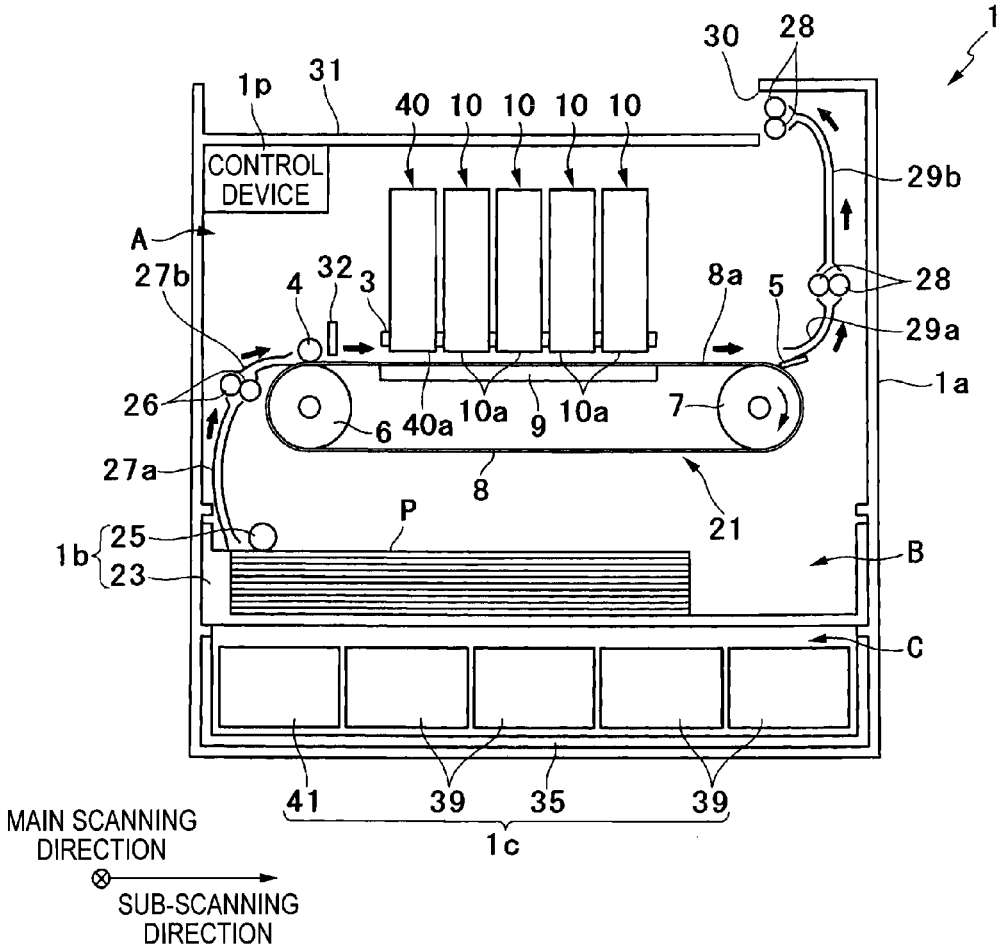
FIG. 1 is a schematic side view showing the internal structure of an inkjet printer according to a first embodiment of a liquid ejecting apparatus of the invention.

The entire structure of an inkjet printer 1 according to a first embodiment of a liquid ejecting apparatus of the invention will be described first with reference to FIG. 1.

The printer 1 contains a rectangular parallelepiped housing 1*a*. A sheet discharge section 31 is formed on the top plate of the housing 1*a*. The inner space of the housing 1*a* may be divided into spaces A, B, and C in this order from above. A sheet conveying path leading to the sheet discharge section 31 is formed in the spaces A and B. A cartridge 41 as a treatment liquid supply source and four cartridges 39 as ink supply sources are received in the space C.

A pre-coating head 40, four heads 10, a conveying unit 21 that conveys a sheet P, a guide unit (to be described below) that guides a sheet P, and the like are disposed in the space A. A control device 1*p*, which takes charge of the operation of the entire printer 1 by controlling the operation of each part of the printer 1, is disposed at the upper portion of the space A.

The control device 1*p* controls the preparation operation that is involved in recording an image; the operations that feed, convey, and discharge a sheet P; an operation that ejects an ink or a pre-treatment liquid and is synchronized with the conveyance of a sheet P; and the like on the basis of a record command sent from an external device such as a PC so that an image is recorded on a sheet P.

The pre-treatment liquid has any one of, for example, at least an action for improving density (an action for improving the density of an ink ejected to a sheet P), an action for preventing the bleeding or strike-through of an ink (a phenomenon where an ink landed on the surface of a sheet P passes through the layer of the sheet P and bleeds out on the back of the sheet), an action for improving a color developing property or a quick drying property of an ink, an action for suppressing the crinkle or curl in a sheet P on which an ink has been landed, and the like. A liquid containing multivalent metal salt such as magnesium salt, a cationic polymer, or the like may be appropriately selected as the material of the pre-treatment liquid.

Each of the heads 10 and 40 is a line type head that has the shape of a substantially rectangular parallelepiped long in the main scanning direction. The heads 10 and 40 are arranged at a predetermined pitch in a sub-scanning direction, and are supported in the housing 1*a* through a head frame 3. When an image is to be recorded, a yellow ink, a magenta ink, a cyan ink, and a black ink are ejected from the lower surfaces (ejection surfaces 10*a*) of four heads 10, respectively. Further, according to the situation, a pre-treatment liquid is ejected from the lower surface (ejection surface 40*a*) of the pre-coating head 40. More specific structure of the heads 10 and 40 will be described in detail below.

The conveying unit 21 contains belt rollers 6 and 7, an endless conveying belt 8 that is wound between both the rollers 6 and 7, a nip roller 4 and a separation plate 5 that are disposed outside the conveying belt 8, a platen 9 that is disposed inside the conveying belt 8, and the like.

Figure 7:
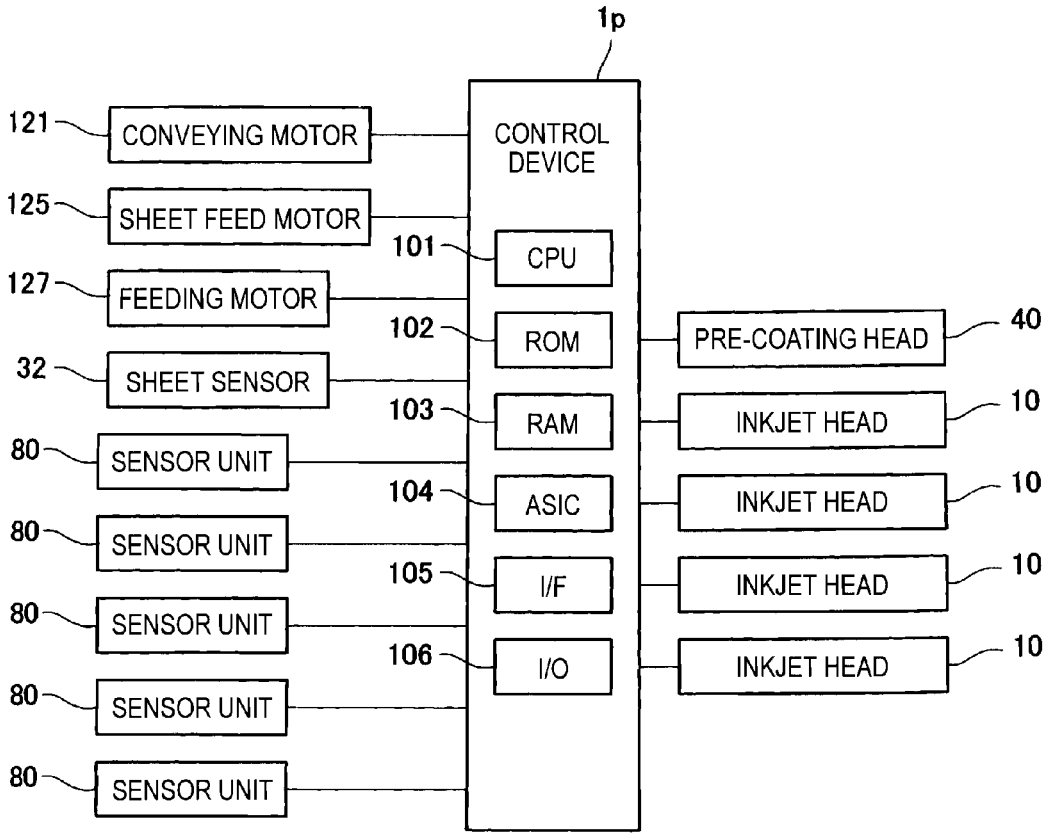
FIG. 7 is a block diagram of the electrical configuration of the printer.

The belt roller 7 is a driving roller, and is rotated by the driving of a conveying motor 121 (see FIG. 7). The belt roller 7 is rotated clockwise in FIG. 1. As the belt roller 7 is rotated, the conveying belt 8 runs in the direction of the thick arrow of FIG. 1. The belt roller 6 is a driven roller, and is rotated clockwise in FIG. 1 as the conveying belt 8 runs. The nip roller 4 is disposed so as to face the belt roller 6, and presses a sheet P, which is fed from an upstream guide section (to be described below), against an outer peripheral surface 8*a* of the conveying belt 8. The separation plate 5 is disposed so as to face the belt roller 7, separates the sheet P from the outer peripheral surface 8*a*, and leads the sheet P to a downstream guide section (to be described below). The platen 9 is disposed so as to face the pre-coating head 40 and the four heads 10, that is, a total of five heads, and supports an upper loop of the conveying belt 8 from the inside of the conveying belt. Accordingly, a predetermined gap, which is suitable to record an image, is formed between the outer peripheral surface 8*a* and each of the ejection surfaces 10*a* and 40*a* of the heads 10 and 40.

The guide unit contains upstream and downstream guide sections that are disposed with the conveying unit 21 interposed therebetween. The upstream guide section contains two guides 27*a* and 27*b* and a pair of feeding rollers 26. The upstream guide section connects a sheet feed unit 1*b* (to be described below) with the conveying unit 21. The downstream guide section contains two guides 29*a* and 29*b* and two pairs of feeding rollers 28. The downstream guide section connects the conveying unit 21 with a sheet discharge section 31.

The sheet feed unit 1*b* is disposed in the space B. The sheet feed unit 1*b* contains a sheet feed tray 23 and a sheet feed roller 25, and the sheet feed tray 23 can be attached to and detached from the housing 1*a*. The sheet feed tray 23 is a box of which the upper side is opened, and stores sheets P having various sizes. The sheet feed roller 25 feeds the uppermost sheet P of the sheets stored in the sheet feed tray 23, and feeds the uppermost sheet to the upstream guide section.

The sheet conveying path, which reaches the sheet discharge section 31 from the sheet feed unit 1*b* through the conveying unit 21, is formed in the spaces A and B as described above. The control device 1*p* drives a sheet feed motor 125 (see FIG. 7) for the sheet feed roller 25, a feeding motor 127 (see FIG. 7) for the feeding rollers of the respective guide sections, a conveying motor 121 (see FIG. 7), and the like on the basis of a record command. The sheet P sent from the sheet feed tray 23 is fed to the conveying unit 21 by the feeding rollers 26. When a sheet P passes through the positions immediately below the respective heads 10 and 40 in the sub-scanning direction, inks are sequentially ejected from the ejection surface 10*a* (and a pre-treatment liquid is ejected from the ejection surface 40*a* according to the situation), so that a color image is recorded on the sheet P. An operation for ejecting the ink or the pre-treatment liquid is performed on the basis of a detection signal from a sheet sensor 32 that detects the front end of the sheet P. Then, the sheet P is separated by the separation plate 5, and is conveyed upward by the two feeding rollers 28. In addition, the sheet P is discharged to the sheet discharge section 31 from an upper opening 30.

Here, the sub-scanning direction is a direction parallel to a conveying direction where the sheet P is conveyed by the conveying unit 21, and the main scanning direction is a direction that is parallel to a horizontal plane and orthogonal to the sub-scanning direction.

A cartridge unit 1*c* is disposed in the space C so as to be attached to and detached from the housing 1*a*. The cartridge unit 1*c* contains a tray 35, and the five cartridges 39 and 41 that are received side by side in the tray 35. The cartridges 39 contain inks, and the cartridge 41 contains a pre-treatment liquid. The cartridges 39 and 41 supply the inks or the pre-treatment liquid to the corresponding heads 10 and 40 through tubes (not shown).

The structure of the heads 10 and 40 will be described next. Since the structure of the head 10 is the same as that of the head 40, the structure of the inkjet head 10 will be described below with reference to FIGS. 2 to 5. Meanwhile, pressure chambers 16 and apertures 15, which are provided below the actuator units 17 and should be shown by a dotted line, are shown by a solid line in FIG. 3.

Figure 5:
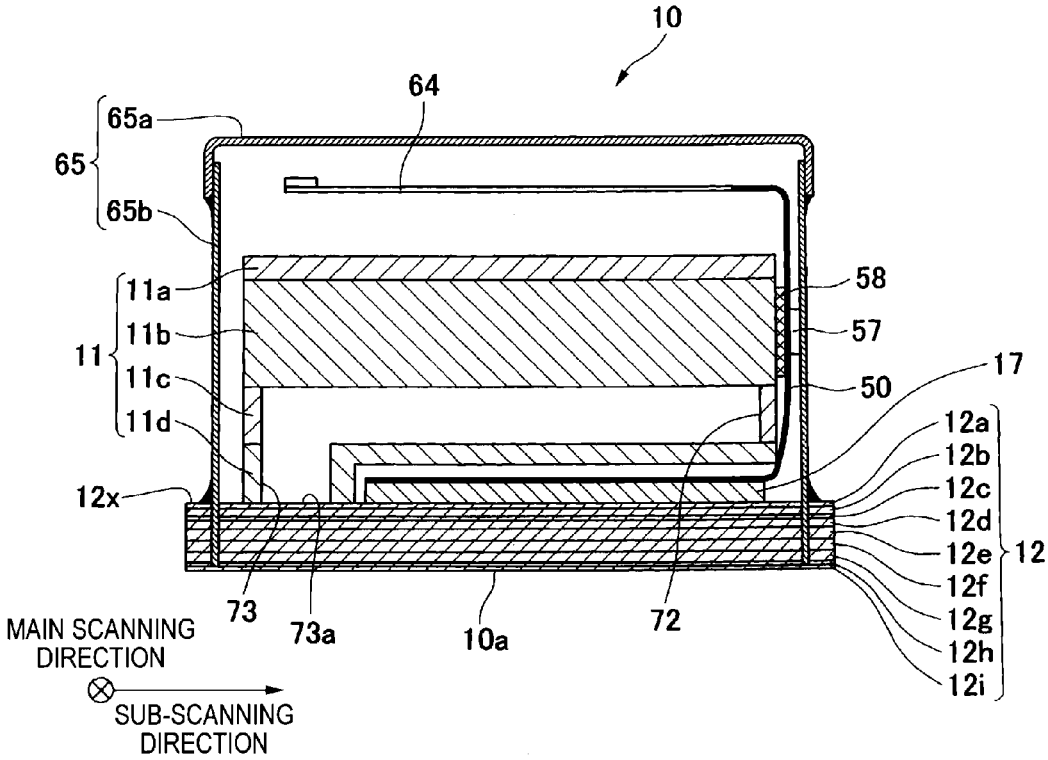
FIG. 5 is a longitudinal sectional view of the inkjet head.

As shown in FIG. 5, the head 10 is a laminate where a flow passage unit 12, actuator units 17, a reservoir unit 11, and a substrate 64 are laminated. Among them, the actuator units 17, the reservoir unit 11, and the substrate 64 are received in a space that is formed by an upper surface 12*x* of the flow passage unit 12 and a cover 65. In the space, an FPC (flexible printed circuit board) 50 is electrically connected to the actuator units 17 and the substrate 64. A driver IC 57 is mounted on the FPC 50.

As shown in FIG. 5, the cover 65 includes a top cover 65*a* and a side cover 65*b* made of aluminum. The cover 65 is a box of which the lower side is opened, and is fixed to the upper surface 12*x* of the flow passage unit 12. The driver IC 57 is pushed by an elastic member (for example, sponge) 58, comes into contact with the inner surface of the side cover 65*b*, and is thermally connected to the cover 65*b*. Meanwhile, the elastic member 58 is fixed to the side surface of the reservoir unit 11.

The reservoir unit 11 is a laminate where four metal plates 11*a* to 11*d* are bonded to each other. Flow passages, which contain a reservoir 72 retaining liquid, are formed in the reservoir unit 11. The ends of the flow passages are connected to the cartridges 39 (a cartridge 41 in the case of the pre-coating head 40) through tubes or the like, and the other ends thereof are connected to the flow passage unit 12. Concave and convex portions are formed on the lower surface of the plate 11*d* as shown in FIG. 5, and a space is formed between the lower surface of the concave portion and the upper surface 12*x*. The actuator units 17 are fixed to the upper surface 12*x* in the space so that a small gap is formed above the FPC 50. Meanwhile, outflow passages 73, which are connected to the reservoir 72, are opened at the end face of the convex portion (the joint surface between the upper surface 12*x* and the reservoir unit).

Figure 2:
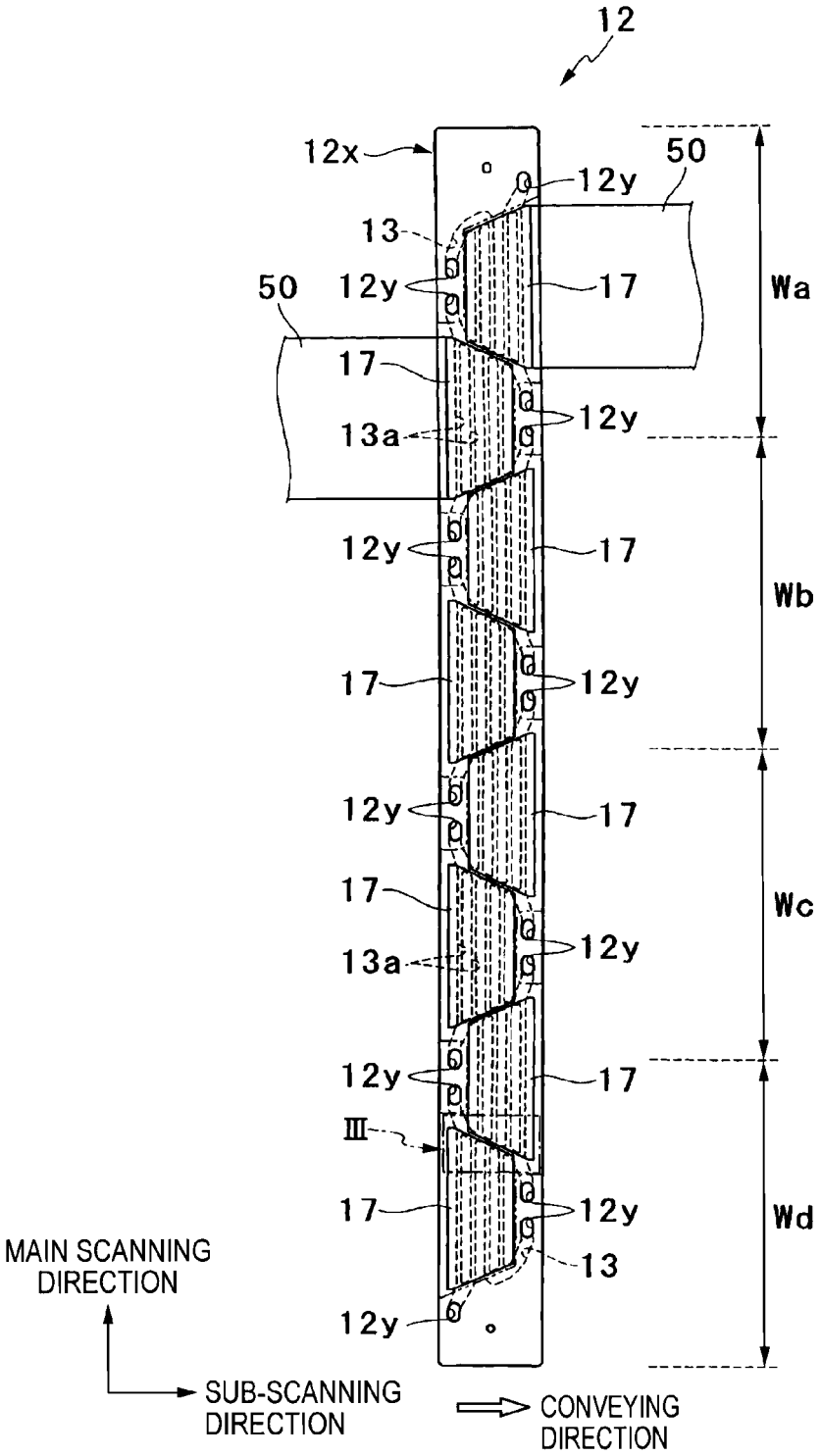
FIG. 2 is a plan view showing a flow passage unit and actuator units of an inkjet head that is contained in the printer.
Figure 3:
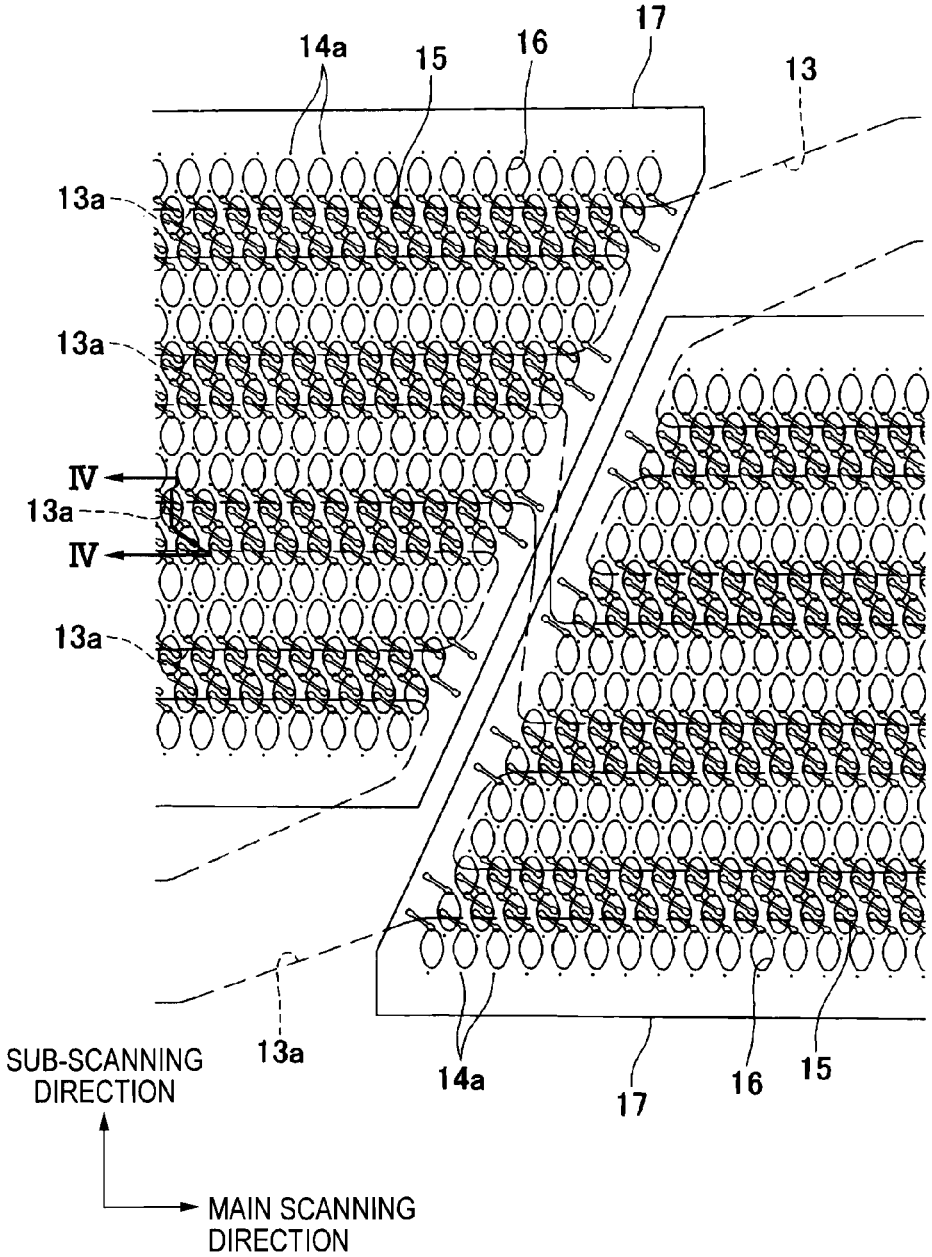
FIG. 3 is an enlarged view of an area III that is surrounded by a dashed dotted line of FIG. 2.
Figure 4:
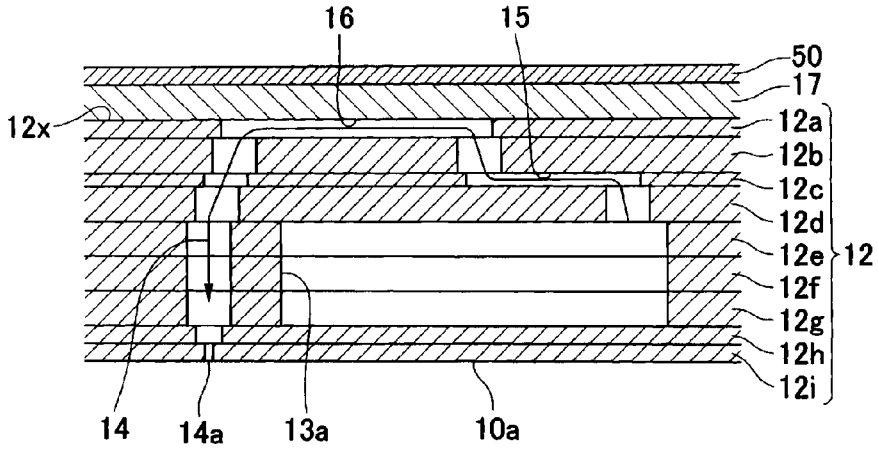
FIG. 4 is a partial sectional view taken along a line IV-IV of FIG. 3.

The flow passage unit 12 is a laminate where nine rectangular metal plates 12*a*, 12*b*, 12*c*, 12*d*, 12*e*, 12*f*, 12*g*, 12*h*, and 12*i* (see FIG. 4) having substantially the same size are bonded to each other. Openings 12*y* are formed at the upper surface 12*x* of the flow passage unit 12 as shown in FIG. 2, and are connected to openings 73*a* of the respective outflow passages 73. Flow passages, which are connected to the openings 12*y* formed at the upper surface 12*x* and ejection ports 14*a* formed at the lower surface of the flow passage unit, are formed in the flow passage unit 12. As shown in FIGS. 2, 3, and 4, the flow passages contain manifold flow passages 13, sub-manifold flow passages 13*a*, and individual flow passages 14. The manifold flow passages 13 contain the openings 12*y* at one ends thereof. The sub-manifold flow passages 13*a* are branched from the manifold flow passages 13. The individual flow passages 14 reach the ejection ports 14*a* from the outlets of the sub-manifold flow passages 13*a* via the pressure chambers 16.

The individual flow passages 14 are formed at the ejection ports 14*a*, respectively. As shown in FIG. 4, each of the individual flow passages 14 contains an aperture 15 that functions as a throttle for adjusting the resistance of the flow passage, and the pressure chamber 16 that is opened to the upper surface 12*x*. As shown in FIG. 3, each of the pressure chambers 16 has a substantially rhombic shape and the pressure chambers are disposed in a matrix so as to form eight pressure chamber groups that occupy a substantially trapezoidal area in plan view. Like the pressure chambers 16, the ejection ports 14*a* are also disposed in a matrix on the ejection surfaces 10*a* so as to form eight ejection port groups. In plan view, one pressure chamber group overlaps with one ejection port group.

As shown in FIG. 2, each of the actuator units 17 has a trapezoidal shape in plan view and the actuator units are disposed in a zigzag in two rows on the upper surface 12*x*. As shown in FIG. 3, the respective actuator units 17 are disposed on the trapezoidal area that is occupied by the pressure chamber groups (ejection port groups). Each of the actuator units 17 contains a plurality of piezoelectric actuators that can be selectively driven in the pressure chambers 16 (the ejection ports 14*a*), respectively.

Although not shown, the actuator unit 17 contains piezoelectric layers each of which has a trapezoidal shape in plan view and extends over the corresponding pressure chamber group and electrodes (individual electrodes and common electrodes) between which the piezoelectric layer is interposed. The individual electrodes are provided in the pressure chambers 16 and form piezoelectric actuators, respectively. Here, the individual electrodes are formed on the surface of the uppermost piezoelectric layer.

The FPC 50 is provided in each of the actuator units 17, and contains a plurality of wires and terminals that correspond to the individual electrodes. The respective wires are connected to the output terminal of the driver IC 57. The FPC 50 transmits data, which is adjusted by the substrate 64, to the driver IC 57 under the control that is performed by the control device 1*p* (see FIG. 1), and transmits driving signals, which are generated by the driver IC 57, to the respective individual electrodes. The driving signals are selectively applied to the respective individual electrodes.

The heads 10 and 40 are provided with sensor units 80 that detect the contact between a sheet P and the ejection surfaces 10*a* and 40*a*, respectively.

The structure of the sensor unit 80 will be described below with reference to FIG. 6. Meanwhile, the sensor unit 80 of the head 10 will be described below, but the sensor unit 80 of the head 40 has the same structure as the structure of the sensor unit of the head 10.

Figure 6A:
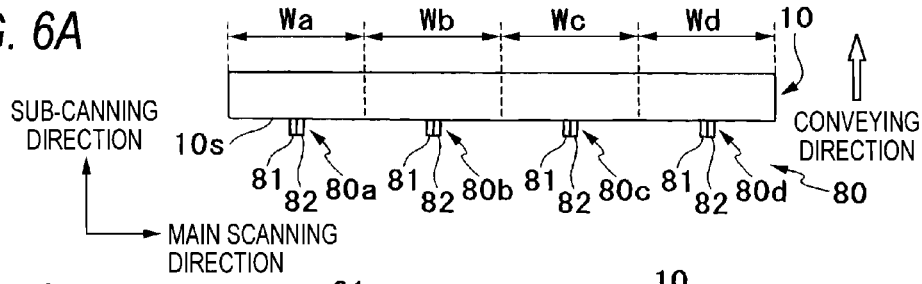
FIG. 6A is a plan view showing sensors.

As shown in FIG. 6A, the sensor unit 80 contains four sensor sets 80*a*, 80*b*, 80*c*, and 80*d*. Each of the sensor sets 80*a* to 80*d* contains a strong-contact sensor 81, a weak-contact sensor 82, and conduction checkers 89 (see FIGS. 6B and 6C) that are provided at the sensors 81 and 82, respectively.

The sensor sets 80*a* to 80*d* are disposed near an upstream side 10*s* (the side along the main scanning direction that is shown on the lower side in FIG. 6A) in the conveying direction (a relative movement direction where the sheet P is moved relative to the ejection surface 10*a*) among the sides which define the ejection surface 10*a*, and are disposed along the side 10*s*. The sensor sets 80*a* to 80*d* correspond to the respective two actuator units 17, and are disposed at equal intervals. The respective sensor sets 80*a* to 80*d* face an area which is positioned in the middle between the two actuator units 17 in the main scanning direction and in which the actuator units 17 overlap each other in the sub-scanning direction.

As shown in FIGS. 6A and 2, an image forming area of the head 10 is divided into four areas Wa to Wd so as to correspond to the disposition of the sensor sets 80*a* to 80*d* and two actuator units 17. As described below, detection results of the sensor sets 80*a* to 80*d* are reflected on the contents of maintenance associated with two actuator units 17 to which the detection results correspond.

Each of the sensor sets 80*a* to 80*d* can detect the intensity of the contact between a sheet P and the ejection surface 10*a* by the detection results of one set of sensors 81 and 82. As shown in FIG. 6A, one set of sensors 81 and 82 are adjacent to each other with a small gap therebetween in the main scanning direction.

Figure 6B:
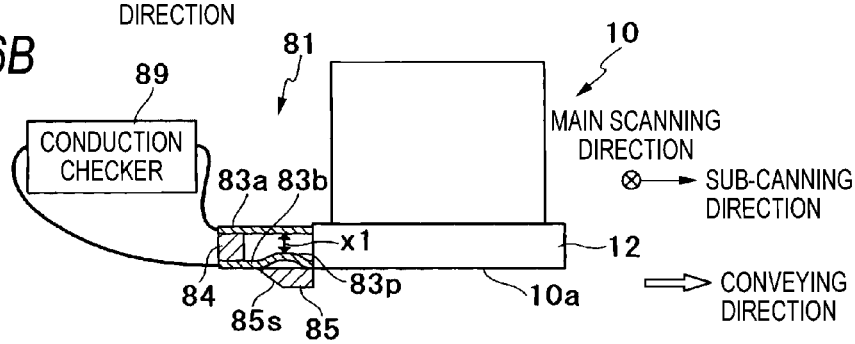
FIG. 6B is a partial side sectional view of a strong-contact sensor.
Figure 6C:
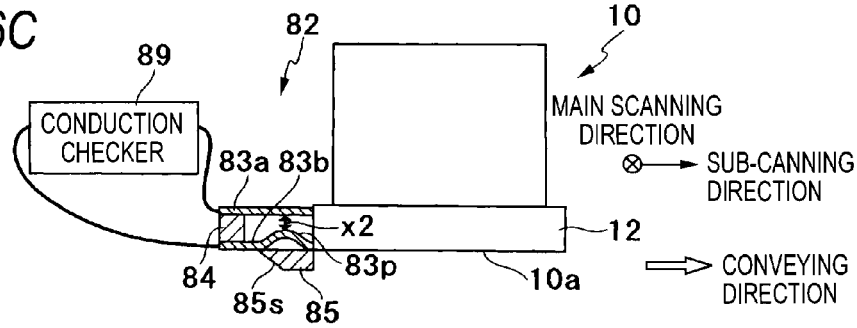
FIG. 6C is a partial side sectional view of a weak-contact sensor.

As shown in FIGS. 6B and 6C, each of the sensors 81 and 82 contains an upper electrode 83*a*, a lower electrode 83*b*, an elastic insulator 84 interposed between both the electrodes 83*a* and 83*b*, and a contact member 85. Among them, the upper electrode 83*a* has a predetermined positional relation between the head 10 and itself, and is directly fixed to the head 10. The upper electrode 83*a* is substantially horizontally supported so as to face the upstream side in the conveying direction. The insulator 84 is an elastic piece having the shape of a flat plate, and is fixed to the lower surface of the upstream end portion of the upper electrode 83*a* in the conveying direction. The upper surface of the upstream end portion of the lower electrode 83*b* is fixed to the lower surface of the insulator 84. The lower electrode 83*b* extends parallel to the upper electrode 83*a* (that is, substantially horizontally). The downstream end portion of the lower electrode 83*b* is a free end and is freely displaced in a vertical direction (that is, the lower electrode 83*b* functions as a kind of elastic member). The contact member 85 is fixed to the lower surface of the lower electrode 83*b*. When a sheet P comes into contact with the contact member 85 as shown in FIG. 6D, the lower electrode 83*b* (the contact member 85) is displaced by the pressure force applied from the sheet P.

Figure 6D:
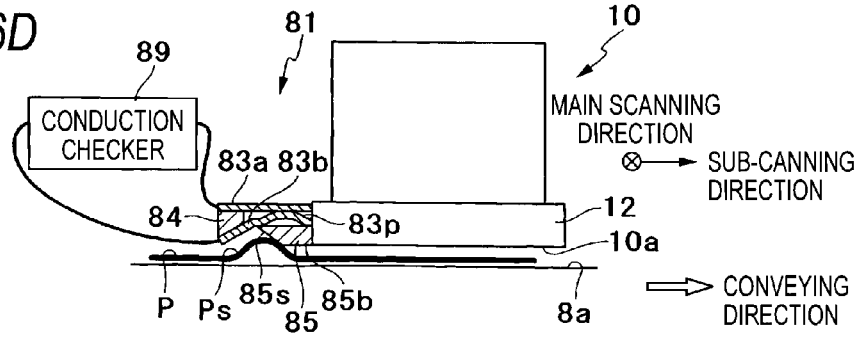
FIG. 6D is a partial side sectional view showing a state where the sensor detects contact (a state where a sheet is to come into contact with an ejection surface)

Except when the detection of contact is performed as shown in FIG. 6D, the upper and lower electrodes 83*a* and 83*b* are separated from each other in the vertical direction. The lower electrode 83*b* contains a convex portion 83*p* that protrudes upward. The convex portion 83*p* is formed at a portion of the lower electrode that is positioned on the downstream side in the conveying direction as compared to the middle of the lower electrode in the sub-scanning direction. The sensors 81 and 82 are different from each other in terms of the height of the convex portion. The height of the convex portion of the sensor 81 is lower than that of the sensor 82. For this reason, the free stroke x1 of the convex portion of the sensor 81 until the contact (conduction) between the upper and lower electrodes 83*a* and 83*b* is larger than the free stroke x2 of the convex portion of the sensor 82 until the contact (conduction) therebetween (x1>x2). Meanwhile, the other members are common to the sensors 81 and 82.

The contact member 85 is positioned at the lowest position among components of the sensors 81 and 82, and has an inclined surface 85*s* that is formed at the lower portion of an upstream portion thereof in the conveying direction. The inclined surface 85*s* is a surface facing a sheet P, which is being conveyed, and is inclined so as to be close to the sheet P toward the downstream side in the conveying direction.

The conduction checker 89 is electrically connected to the respective electrodes 83*a* and 83*b* that are contained in each of the corresponding sensors 81 and 82. The conduction checker 89 detects the state of the contact (whether conduction occurs) between the electrodes 83*a* and 83*b*, and sends a detection signal to the control device 1*p* when the conduction is detected.

For example, when a protuberant portion is partially formed at the sheet P to be conveyed as shown in FIG. 6D, the protuberant portion Ps comes into contact with the contact member 85. The protuberant portion Ps comes into contact with the inclined surface 85*s* first, and the sheet is further moved in the conveying direction. In this case, an upward pressing force is applied to the contact member 85 from the protuberant portion Ps. Accordingly, the contact member 85 is moved up, and the downstream portion of the lower electrode 83*b* in the conveying direction is also moved up. Further, when the tip of the convex portion 83*p* comes into contact with the upper electrode 83*a*, conduction is detected by the conduction checker 89.

All the lower electrodes 83*b* of the sensors 81 and 82 are elastic members, and the amount of displacement of the lower electrodes is changed by a pressing force. If the protuberance of the protuberant portion Ps is large, it is assumed that the pressing force applied by the protuberant portion is large. Accordingly, the lower electrode 83*b* is significantly displaced.

The free stroke x2 of the sensor 82 is relatively small, and the convex portion 83*p* of the sensor 82 comes into contact with the upper electrode 83*a* even by a small pressing force. In this case, it is supposed that the sheet P comes into slide contact with a part of the ejection surface 10*a* with a small pressing force even though the conveyance of the sheet is stopped.

The free stroke x1 of the sensor 81 is relatively large, and the convex portion 83*p* of the sensor 81 comes into contact with the upper electrode 83*a* even by a large pressing force. In this case, the lower electrode 83*b* of the sensor 82 follows the displacement of the lower electrode 83*b* of the sensor 81 and also comes into contact with the upper electrode 83*a* while the convex portion 83*p* of the sensor 82 is deformed. In this case, it is supposed that the sheet P comes into slide contact with a part of the ejection surface 10*a* with a large pressing force even though the conveyance of the sheet is stopped.

Meanwhile, when the convex portion 83*p* of each of the sensors 81 and 82 comes into contact with the upper electrode 83*a*, the height of the lower surface 85*b* of the contact member 85 is substantially equal to that of the ejection surface 10*a* as shown in FIG. 6D. Accordingly, after the detection of conduction, the protuberant portion Ps of the sheet P is smoothly guided to the ejection surface 10*a* along the inclined surface 85*s* and the lower surface 85*b*.

Next, the electrical structure of the printer 1 will be described with reference to FIG. 7.

The control device 1*p* contains a ROM (Read Only Memory) 102, a RAM (Random Access Memory including a nonvolatile RAM) 103, an ASIC (Application Specific Integrated Circuit) 104, an I/F (Interface) 105, an I/O (Input/Output Port) 106, and the like, in addition to a CPU (Central Processing Unit) 101 that is an arithmetic processing unit. Programs (including a routine shown in FIG. 8) executed by the CPU 101, various kinds of fixed data (including a table shown in FIG. 10), and the like are stored in the ROM 102. Data (image data or the like), which is necessary at the time of the execution of a program, is temporarily stored in the RAM 103. The rewriting, rearrangement, and the like (signal processing or image processing) of image data are performed in the ASIC 104. The I/F 105 transmits and receives data to/from an external device. The I/O 106 inputs and outputs detection signals of various kinds of sensors.

The control device 1*p* is connected to the respective motors 121, 125, and 127, the sheet sensor 32, the substrates 64 of the respective heads 10 and 40, and the respective conduction checkers 89 of the sensor units 80 (total eight conduction checkers 89 that correspond to two sensors 81 and 82 contained in the respective sensor sets 80*a* to 80*d*, as for one sensor unit 80).

Next, the contents of the control associated with the detection of the contact between the sheet P and the ejection surfaces 10*a* and 40*a*, which is performed by the control device 1*p*, will be described with reference to FIG. 8.

Figure 8:
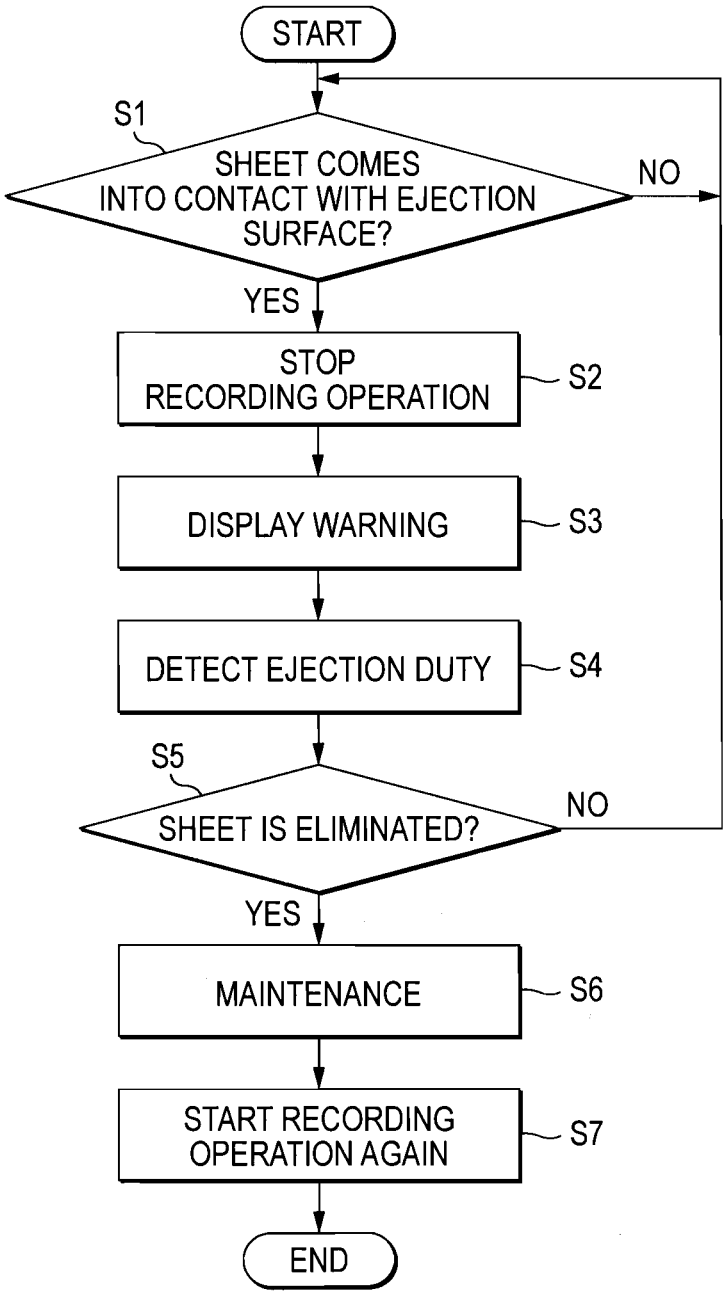
FIG. 8 is a flow chart illustrating a routine, which is executed by a control device of the printer, according to the detection of the contact between the ejection surface and a sheet.

The control device 1*p* repeatedly performs the routine shown in FIG. 8 while performing the respective parts of the printer 1 on the basis of a record command after receiving the record command.

First, the control device 1*p* determines whether the sheet P comes into contact with the ejection surfaces 10*a* and 40*a* on the basis of the detection signals from the conduction checkers 89 (S1). When receiving the detection signal from any one of the conduction checkers 89, the control device 1*p* determines that the sheet P comes into contact with the ejection surfaces 10*a* and 40*a* (YES in S1).

Meanwhile, the sheet P may not come into contact with the ejection surfaces 10*a* and 40*a* yet as shown in FIG. 6D at the timing where detection signals are sent from the conduction checkers 89. However, even in this case, the control device determines that the sheet comes into contact with the ejection surfaces (YES in S1).

When determining that the sheet comes into contact with the ejection surfaces (YES in S1), the control device 1*p* stops the operation based on the record command (an operation for conveying a sheet P, an operation for feeding a new sheet P, operations for ejecting inks and a pre-treatment liquid, and the like) (S2). After S2, the control device 1*p* displays a warning, which is associated with the contact between the sheet P and the ejection surfaces, on a display unit of the printer 1 and urges a user to eliminate the sheet P (S3).

After S3, the control device 1*p* detects an ejection duty of inks and a pre-treatment liquid of an image formed in an area of the sheet P that comes into contact with the ejection surfaces 10*a* and 40*a* (S4). In this case, first, the control device 1*p* specifies an area Z (see FIG. 9) of the sheet P coming into contact with the ejection surfaces 10*a* and 40*a*. Then, the control device detects an ejection duty of inks and a pre-treatment liquid of an image, which is formed in the area Z, on the basis of the image data stored in the RAM 103.

Here, an example of a method of specifying the area Z will be described.

Figure 9:
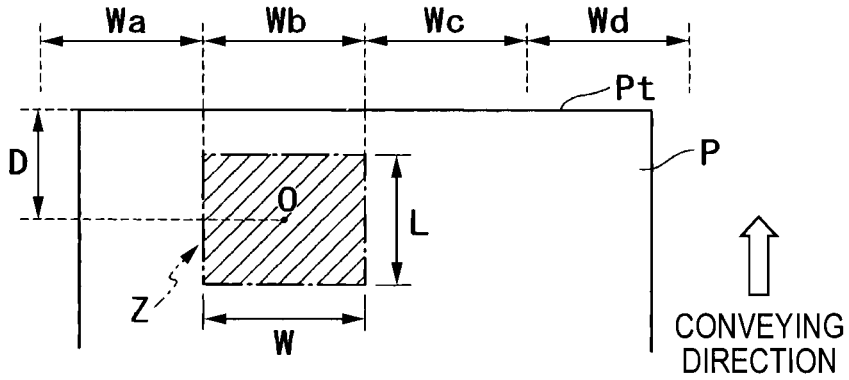
FIG. 9 is a schematic plan view illustrating a method of specifying an area of a sheet that comes into contact with the ejection surface.

In this example, the control device specifies the rectangular area Z shown in FIG. 9. The area Z is specified by the position of a center O, a width W, and a length L. The center O overlaps with the positions of the sensor sets 80*a* to 80*d* that detect the "contact" in the sub-scanning direction. The width W is equal to the widths of areas Wa to Wd to which the sensor sets 80*a* to 80*d* correspond. Further, a distance D between the center O and a tip Pt of the sheet P is calculated on the basis of the conveying speed V of the sheet P (the running speed of the conveying belt 8) and a time T between a time point where the sheet sensor 32 detects the tip Pt and a time point where the detection of contact is performed (a time point where the conduction checker 89 detects conduction). The length L is variable according to, for example, a contact time, and may be appropriately set. In this embodiment, the length L is equal to the widths of the ejection surfaces 10*a* and 40*a*.

The ejection duty, which is detected in S4, is a total ejection duty of inks and a pre-treatment liquid ejected to the area Z from heads 10 and 40 that are disposed on the upstream side in the conveying direction as compared to the heads 10 and 40. The ejection duty is detected for all the heads 10 and 40 disposed on the upstream side of the heads 10 and 40, of which the contact is detected, in the conveying direction. In this case, the ejection duty detected for the pre-coating head 40, which is disposed on the most upstream side in the conveying direction, is always 0%. Further, the upper limits of the ejection duties, which are detected for the respective four inkjet heads 10, are 100%, 200%, 300%, and 400% toward the downstream side from the upstream side in the conveying direction, respectively.

After S4, the control device 1*p* determines whether the jammed sheet P is eliminated (S5). Here, if all the sensor sets 80*a* to 80*d* output detection signals corresponding to "non-contact" while the printer 1 can start forming (recording) an image at any time, the control device 1*p* determines that the sheet P is eliminated (YES in S5). If the sheet P is not eliminated (NO in S5), the control device 1*p* returns processing to S1. If the sheet P is eliminated (YES in S5), the control device 1*p* makes processing proceed to S6.

In S6, the control device 1*p* performs the maintenance of the corresponding heads 10 and 40 on the basis of the total ejection duty that has been detected in S4. The contents of the maintenance of the pre-coating head 40 are determined on the basis of the detection results of the sensors 81 and 82.

The maintenance basically includes the compulsory ejection of a liquid (an ink or a pre-treatment liquid) and the wiping of the ejection surfaces 10*a* and 40*a*. In the wiping, the ejection surfaces 10*a* and 40*a* are wiped by a wiper that is an elastic body.

The compulsory ejection includes purge and flushing.

Purge unit an operation that compulsorily ejects a liquid from the ejection ports 14*a* by pressurizing or sucking the flow passages of the heads 10 and 40 with a pump. The purge includes three kinds of purge (small purge, medium purge, and large purge) having three levels of intensity depending on the intensity of pressure applied from the pump.

Flushing unit an operation that compulsorily ejects a liquid from the ejection ports 14*a* by driving all the piezoelectric actuators on the basis of flushing data. Flushing includes three kinds of flushing (weak flushing, medium flushing, and strong flushing) having three levels of intensity depending on the number of ejections per unit of time.

In this embodiment, the compulsory ejection includes six kinds of compulsory ejection, that is, small purge, medium purge, large purge, weak flushing, medium flushing, and strong flushing. (Meanwhile, small, medium, and large correspond to the total amount of the inks or the pre-treatment liquid ejected from the respective ejection surfaces 10*a* and 40*a*.)

In S6, the control device 1*p* refers to a table shown in FIG. 10 and determines which one of the above-mentioned six kinds of compulsory ejection is performed for each of the heads 10 and 40 according to the intensity of contact and the ejection duty detected in S4.

Here, the intensity of contact is determined depending on which one of the strong-contact sensor 81 and the weak-contact sensor 82 performs the detection of contact in S1.

For example, there will be described a case where the contact (of which intensity is weak) between a sheet P and the third head (magenta head) 10 from the upstream side in the conveying direction is detected.

If the total ejection duty d (%) of two heads 10 and 40, which are disposed on the upstream side of the magenta head 10 in the conveying direction, satisfies "0≤d<75" as for the above-mentioned area Z, weak flushing is performed on the magenta head 10. Likewise, according to the table shown in FIG. 10, medium flushing is performed if "75≤d<150" is satisfied on the magenta head 10, and strong flushing is performed if "150≤d<225" is satisfied on the magenta head 10.

Further, when the contact (of which intensity is strong) between a sheet P and the third head (magenta head) 10 from the upstream side in the conveying direction is detected, likewise, each of small purge, medium purge, and large purge is performed on the magenta head 10 according to the total ejection duty.

Further, when about to perform flushing in S6, the control device 1*p* may select an ejection port group corresponding to the sensor sets 80*a* to 80*d*, which detect contact, and select the ejection ports 14*a* contained in the ejection port group as an object to be flushed without ejecting inks or a pre-treatment liquid from all the ejection port 14*a* of the corresponding heads 10 and 40.

For example, when the sensor set 80*b* detects the contact between a sheet P and the heads, the control device selects the ejection port group corresponding to the area Wb of the corresponding heads 10 and 40. Further, the control device drives two actuator units 17 corresponding to the area Wb, and ejects inks or a pre-treatment liquid from the ejection ports 14*a* of the ejection port group corresponding to the area Wb.

After the above-mentioned compulsory ejection is ended, the control device 1*p* performs wiping and ends maintenance.

After S6, the control device 1*p* starts a recording operation again (S7). That is, the control device performs operations for feeding and conveying a new sheet P, operations for ejecting inks and a pre-treatment liquid, and the like, on the basis of image data associated with the recording that is performed when contact is detected in S1.

After S7, the control device 1*p* ends this routine.

As described above, according to the program, the control device 1*p*, and the printer 1 of this embodiment, the amount of inks and a pre-treatment liquid to be ejected is adjusted according to an ejection duty (see FIG. 10) in the compulsory ejection that is associated with the contact between a sheet P and the ejection surfaces 10*a* and 40*a*. Accordingly, it may be possible to reduce the waste of the inks and pre-treatment liquid.

The control device 1*p* selects not all the ejection ports 14*a* but the ejection ports 14*a* corresponding to the sensor sets 80*a* to 80*d*, which detect the contact between a sheet P and the ejection surfaces 10*a* and 40*a*, and performs flushing on the ejection ports 14*a*. It may be possible to reliably reduce the waste of the inks and pre-treatment liquid by selectively performing compulsory ejection as described above.

Further, when performing the above-mentioned selective compulsory ejection, the control device 1*p* according to this embodiment selects an ejection port group and drives the actuator units 17 corresponding to the ejection port group. Accordingly, it may be possible to relatively easily perform selective compulsory ejection.

The sensor sets 80*a* to 80*d* are disposed near the upstream side 10*s* in the conveying direction among the sides which define each of the ejection surfaces 10*a* and 40*a* of the line type heads 10 and 40, and are disposed along the side 10*s* so as to be separated from each other (see FIG. 6A). Since the sensor sets 80*a* to 80*d* are disposed near the upstream side 10*s* in the conveying direction in this way, it may be possible to accurately perform the detection of contact. Further, since the four sensor sets 80*a* to 80*d* are disposed along the side 10*s* so as to be separated from each other, it may be possible to more accurately detect an ejection duty according to the detection results of the respective sensor sets 80*a* to 80*d*. Furthermore, it may be possible to more effectively perform the above-mentioned selective compulsory ejection.

Each of the sensor sets 80*a* to 80*d* contains the strong-contact sensor 81 and the weak-contact sensor 82 (see FIGS. 6A to 6C), and the control device 1*p* adjusts the amount of a liquid to be ejected in the compulsory ejection according to the intensity of the contact between a sheet P and the ejection surfaces 10*a* and 40*a* (see FIG. 10). Accordingly, it may be possible to perform more appropriate maintenance and to further effectively reduce the waste of inks and a pre-treatment liquid.

Each of the contact members 85 of the sensors 81 and 82 has an inclined surface 85*s* at the lower portion thereof. Accordingly, when a sheet P, which is being conveyed, comes into contact with the inclined surface 85*s*, the sheet is guided along the inclined surface 85*s* to the ejection surfaces 10*a* and 40*a*. Therefore, the detection performed by the sensors 81 and 82 becomes more accurate. Further, since a sheet P coming into contact with the sensors 81 and 82 is smoothly guided to the ejection surfaces 10*a* and 40*a* if the pressing force of the sheet applied to the sensors 81 and 82 is small, a jam does not easily occur.

Subsequently, an inkjet printer according to a second embodiment of a liquid ejecting apparatus of the invention will be described with reference to FIG. 11.

The structure of the printer according to the second embodiment is substantially the same as that of the printer according to the first embodiment except for heads. Hereinafter, the same components as those of the first embodiment are denoted by the same reference numerals and the description thereof will be omitted.

The printer according to the second embodiment contains not line type inkjet heads but a serial type inkjet head 210. The head 210 can reciprocate a scanning direction (a direction that is the width direction of a sheet P and is orthogonal to the conveying direction) while being supported by a carriage. Accordingly, the head 210 ejects inks to a sheet P while reciprocating. The head 210 may be a head that is formed by combining four heads, which eject a yellow ink, a magenta ink, a cyan ink, and a black ink, respectively, and may be a head that ejects only a black ink. Of course, the head 210 may be a head that is formed by combining a head, which ejects a pre-treatment liquid, with one or a plurality of heads that ejects inks. Alternatively, the printer according to the second embodiment may be provided with not only the head 210 that ejects inks, but also another head that ejects a pre-treatment liquid.

The head 210 is provided with a sensor 280 that detects the contact between a sheet P and an ejection surface. The sensor 280 is provided at one of two sides, which are orthogonal to a scanning direction, among the sides which define the ejection surface. The structure of the sensor 280 may be the same as that of the sensor set 80*a* of the first embodiment.

An example of a method of specifying an area Z of this embodiment will be described.

Figure 11:
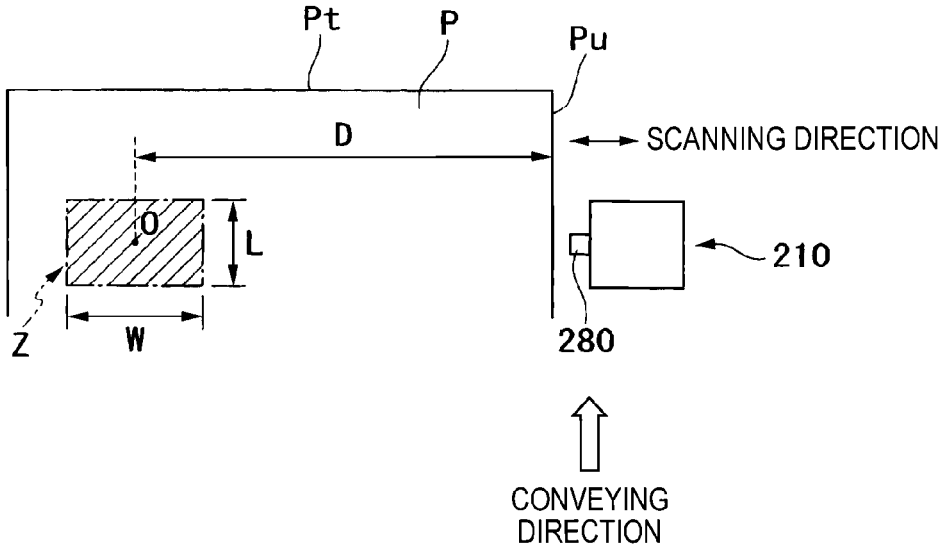
FIG. 11 is a schematic plan view illustrating the disposition of a head and a sensor of an inkjet printer according to a second embodiment of a liquid ejecting apparatus of the invention and a method of specifying an area of a sheet that comes into contact with an ejection surface.

A rectangular area Z, which has a width W and a length L as shown in FIG. 11, is assumed in this example. A center O of the area Z is determined on the basis of a distance D between the center O and one side end Pu of a sheet P and the position of the head 210 in the conveying direction at a time point where the detection of contact is performed. One side end Pu is a side end, which passes through the head 210 before the detection of contact, of two side ends of the sheet P (FIG. 11 shows a case where the detection of contact is performed when the head 210 is moved from the right side to the left side). The distance D is calculated on the basis of the moving speed V of the head 210 and a time T between a time point where the head 210 passes through the side end Pu and a time point where the detection of contact is performed. The width W is variable according to, for example, a contact time, and may be appropriately set. The length L may be equal to the length of the ejection surface of the head 210 in the conveying direction.

Even in this embodiment as in the first embodiment, in the compulsory ejection that is associated with the contact between a sheet P and the ejection surface, the control device 1*p* detects an ejection duty (S4) and adjusts the amount of inks, which are ejected in the compulsory ejection (S6), according to the intensity of contact and the ejection duty. Accordingly, it may be possible to obtain the same advantages as the advantages of the first embodiment.

Meanwhile, since the structure of the head of this embodiment is different from that of the head of the first embodiment, the amount of inks may be adjusted with reference to a table that is different from the table of FIG. 10.

Preferred embodiments of the invention have been described above. However, the invention is not limited to the above-mentioned embodiments, and may have various changes in design within claims.

The actuator unit is not limited to a piezoelectric actuator unit, and may be a thermal actuator unit, a static actuator unit, and the like.

The number of the actuator units has been eight in one head in the above-mentioned embodiment. However, the number of the actuator units may be four and is arbitrary. Further, the shape of the actuator unit is not limited to a trapezoidal shape, and may be a rectangular shape or the like.

Furthermore, the actuator unit may be formed of a plurality of actuators that face pressure chambers, respectively, and are separated from each other.

The arrangement of the ejection port groups is not limited to the zigzag arrangement in the main scanning direction. The ejection port groups may be arranged in one line and the form of the arrangement of the ejection port groups is not particularly limited.

Moreover, the ejection ports may not form a plurality of ejection port groups (for example, the ejection ports may be disposed so as to be uniformly dispersed on the ejection surface).

The structure of the sensor is not limited to a structure that uses a pair of electrodes as in the above-mentioned embodiment, and may be changed arbitrarily.

The number of the sensors is not particularly limited, and one sensor is provided at each of the heads (for example, one sensor is provided in the middle of the head in the main scanning direction).

Only a part of the heads contained in the liquid ejecting apparatus may be provided with sensors.

The sensor may detect three or more levels of the intensity of contact, and may not detect the intensity of contact (the liquid ejecting apparatus may contain only one of the strong-contact sensor 81 and the weak-contact sensor 82 of the first embodiment).

The surface of the sensor facing a recording medium may not be inclined.

Maintenance unit may adjust the amount of a liquid, which is associated with the compulsory ejection, according to not the intensity of contact but only an ejection duty.

In S6, maintenance may be performed on only a head that is provided with a sensor having detected the contact of a sheet in S1, or the head and arbitrary heads except for the head (for example, the head and all the heads disposed on the upstream side of the head in the conveying direction, or all the heads including the head).

FIG. 10 is merely illustrative and various tables may be set according to an ejection duty. For example, according to the above-mentioned embodiments, the pre-coating head 40 is not affected by a head since other heads are not provided on the upstream side of the pre-coating head 40 in the conveying direction. However, compulsory ejection (small purge or weak flushing) is performed in consideration of a fact that the state of a foreign material adhering to the ejection surface 40*a* is different according to the intensity of contact of a sheet P. However, compulsory ejection may not be performed on the pre-coating head 40 in consideration of a fact that the amount of a foreign material adhering to the ejection surface 40*a* is small according to the kind of a sheet P.

In the above-mentioned embodiment, the maintenance unit performs not only compulsory ejection but also wiping. However, the maintenance unit may perform only compulsory ejection without performing wiping.

A method of specifying an area of a recording medium, which comes into contact with the ejection surface, is arbitrary without being limited to the above-mentioned method.

The maintenance unit may adjust one or both of the total amount of liquids ejected from all ejection ports contained in the ejection surface and the amount of a liquid ejected from each ejection port in the compulsory ejection, according to an ejection duty.

The liquid ejecting apparatus according to the invention is not limited to a printer, and may also be applied to a facsimile or a copy machine.

Two or more kinds of liquids, which are ejected from the heads in the invention, are not limited to liquids that include a treatment liquid (a pre-treatment liquid or a post-treatment liquid), and may include only inks of which colors are different from each other. Further, two or more kinds of liquids may include a liquid except for an ink.

The number of the heads, which are contained in the liquid ejecting apparatus according to the invention, may be one or more (for example, one head may contain two divided liquid flow passages and liquids having characteristics different from each other are stored in the respective flow passages).

The recording medium may be a recordable arbitrary medium, and may be, for example, a cloth or the like.

The program according to the invention may be recorded on a removable recording medium, such as a DVD-ROM, a CD-ROM, and a MO, or a fixed recording medium such as a hard disk, and may be distributed. Alternatively, the program may be distributed through a communication network such as an internet by wired or wireless telecommunication unit.

What is claimed is:

1. A liquid ejecting apparatus comprising:

a head that includes an ejection surface where a plurality of ejection ports are opened, the head configured to eject two or more kinds of liquids, which have characteristics different from each other, to a recording medium from the ejection ports;

a sensor that is configured to detect a contact between the recording medium and the ejection surface;

an area specifying unit that is configured, when the sensor detects the contact between the recording medium and the ejection surface, to specify an area of the recording medium that comes into contact with the ejection surface;

an ejection duty detecting unit that is configured, when the area specifying unit specifies the area that comes into contact with the ejection surface, to detect an ejection duty of the liquids of an image formed in the area that comes into contact with the ejection surface; and a maintenance unit that is configured, when the sensor detects the contact, to stop an operation based on a record command and perform maintenance including compulsory ejection which ejects liquids from the ejection ports, wherein the maintenance unit is configured to adjust the amount of the liquids, which are ejected in the compulsory ejection, according to the ejection duty in the area that is detected by the ejection duty detecting unit, and wherein the maintenance unit is configured to select ejection ports, which are formed in the area of the ejection surface coming into contact with the recording medium, and perform the compulsory ejection on the ejection ports formed in the area of the ejection surface.

2. The liquid ejecting apparatus according to claim 1, wherein the plurality of ejection ports forms a plurality of ejection port groups each of which includes one or more ejection ports, the head includes a plurality of actuator units applying ejection energy, which makes the liquids be ejected from the ejection ports, to the liquids so as to correspond to the ejection port groups, respectively, and the maintenance unit is configured to select one or more ejection port groups, and perform the compulsory ejection on ejection ports that are included in the selected ejection port groups.

3. The liquid ejecting apparatus according to claim 1, wherein the head includes a plurality of line type heads each of which includes an ejection surface long in a main scanning direction orthogonal to a conveying direction of the recording medium, and is configured to eject liquids that have characteristics different from each other, wherein the sensor includes a plurality of sensors that are disposed near an upstream side in the conveying direction among sides which define the ejection surface of the heads except for at least the head disposed on the most upstream side in the conveying direction among the plurality of heads, and the sensors are disposed along the upstream side so as to be separated from each other.

4. The liquid ejecting apparatus according to claim 1, wherein the sensor is configured to detect the contact between the recording medium and the ejection surface and an intensity of the contact, and wherein the maintenance unit is configured to adjust the amount of the liquids, which are ejected in the compulsory ejection, according to the intensity of the contact that is detected by the sensor.

5. The liquid ejecting apparatus according to claim 1, wherein the sensor is disposed near an upstream side in a relative movement direction, where the recording medium is moved relative to the ejection surface, among the sides which define the ejection surface, and the surface of the sensor facing the recording medium, which is being relatively moved, is inclined so as to be close to the recording medium toward the downstream side in the relative movement direction.

6. A control device used in a liquid ejecting apparatus including a head and a sensor, the head including an ejection surface where a plurality of ejection ports are opened and configured to eject two or more kinds of liquids, which have characteristics different from each other, to a recording medium from the ejection ports, and the sensor configured to detect a contact between the recording medium and the ejection surface, the control device comprising:

an area specifying unit that is configured, when the sensor detects the contact between the recording medium and the ejection surface, to specify an area of the recording medium that comes into contact with the ejection surface;

an ejection duty detecting unit that is configured, when the area specifying unit specifies the area that comes into contact with the ejection surface, to detect an ejection duty of the liquids of an image formed in the area that comes into contact with the ejection surface; and a maintenance unit that is configured, when the sensors detect the contact, to stop an operation based on a record command and perform maintenance including compulsory ejection which ejects liquids from the ejection ports, wherein the maintenance unit is configured to adjust the amount of the liquids, which are ejected in the compulsory ejection, according to the ejection duty in the area that is detected by the ejection duty detecting unit, and wherein the maintenance unit is configured to select ejection ports, which are formed in an area of the ejection surface coming into contact with the recording medium, and perform the compulsory ejection on the ejection ports formed in the area of the ejection surface.

7. A non-transitory computer readable medium storing a program including computer-readable instructions for controlling a liquid ejecting apparatus, the liquid ejecting apparatus comprising: a head and a sensor, the head including an ejection surface where a plurality of ejection ports are opened and configured to eject two or more kinds of liquids, which have characteristics different from each other, to a recording medium from the ejection ports; and the sensor configured to detect a contact between the recording medium and the ejection surface, the program, when executed by a computer of the liquid ejecting apparatus, causing the liquid ejecting apparatus to perform processes comprising:

when the sensor detects the contact between the recording medium and the ejection surface, specifying an area of the recording medium that comes into contact with the ejection surface;

when the area specifying unit specifies the area that comes into contact with the ejection surface, detecting an ejection duty of the liquids of an image formed in the area that comes into contact with the ejection surface; and when the sensor detects the contact, stopping an operation based on a record command and performing maintenance including compulsory ejection which ejects liquids from the ejection ports while adjusting the amount of the liquids, which are ejected in the compulsory ejection, according to the detected ejection duty in the area, wherein the performing the maintenance includes selecting ejection ports, which are formed in an area of the ejection surface coming into contact with the recording medium, and performing the compulsory ejection on the ejection ports formed in the area of the ejection surface.

* * * * *